US005291881A

United States Patent [19]

Drews et al.

[11] Patent Number: 5,291,881

[45] Date of Patent: Mar. 8, 1994

[54] AIR CLEANING CARTRIDGE FOR A GAS MASK AND BREATHING EQUIPMENT WITH AN INSERT

[75] Inventors: Wolfgang Drews, Zarpen; Gunther Kolbe, Mölln; Stephan Melzer, Bad Schwattau; Hasso Weinmann, Lübeck, all of Fed. Rep. of Germany

[73] Assignee: Dragerwerk Aktiengesellschaft, Lubeck, Fed. Rep. of Germany

[21] Appl. No.: 895,528

[22] Filed: Jun. 3, 1992

[30] Foreign Application Priority Data

Jun. 14, 1991 [DE] Fed. Rep. of Germany ..... 4119660

[51] Int. Cl.[5] ..... A62B 7/10

[52] U.S. Cl. ..... 128/205.27; 128/205.28; 128/205.12

[58] Field of Search ..... 128/201.25, 202.26, 128/205.12, 205.28, 205.27; 55/387, 388, DIG. 33

[56] References Cited

U.S. PATENT DOCUMENTS

| | | | |
|---|---|---|---|
| 1,843,446 | 2/1932 | Dräger | 55/DIG. 33 |
| 2,038,071 | 4/1936 | Wilhelm | 55/388 |
| 3,752,654 | 8/1973 | Johannisson et al. | 55/387 |
| 4,013,566 | 3/1977 | Taylor | 55/387 |
| 4,193,966 | 3/1980 | Dowgul | 422/122 |
| 4,225,562 | 9/1980 | Anderson | 55/387 |
| 4,289,513 | 9/1981 | Broonhill et al. | 55/387 |
| 4,875,520 | 10/1989 | Steele et al. | 55/388 |
| 4,992,084 | 2/1991 | Von Blücher et al. | 55/387 |
| 5,129,929 | 7/1992 | Linnersten | 55/387 |
| 5,160,355 | 11/1992 | Toppel | 55/387 |

FOREIGN PATENT DOCUMENTS

| | | |
|---|---|---|
| 297927 | 7/1915 | Fed. Rep. of Germany . |
| 207614 | 3/1940 | Switzerland . |

*Primary Examiner*—Edgar S. Burr
*Assistant Examiner*—Aaron J. Lewis
*Attorney, Agent, or Firm*—McGlew and Tuttle

[57] ABSTRACT

A gas mask and breathing equipment air cleaning cartridge (1) with a carbon dioxide-binding chemical packing (4) and an insert (3). The insert has legs (6) arranged in a radiate pattern perpendicularly to the direction of flow. The legs (6) have a flexibility that compensates for differences in the filling ratios of the strands (5) of chemical and have an identical bent zigzag-shaped designs to provide good heat distribution in the circumferential direction and good resistance to vibrations and shocks.

14 Claims, 1 Drawing Sheet

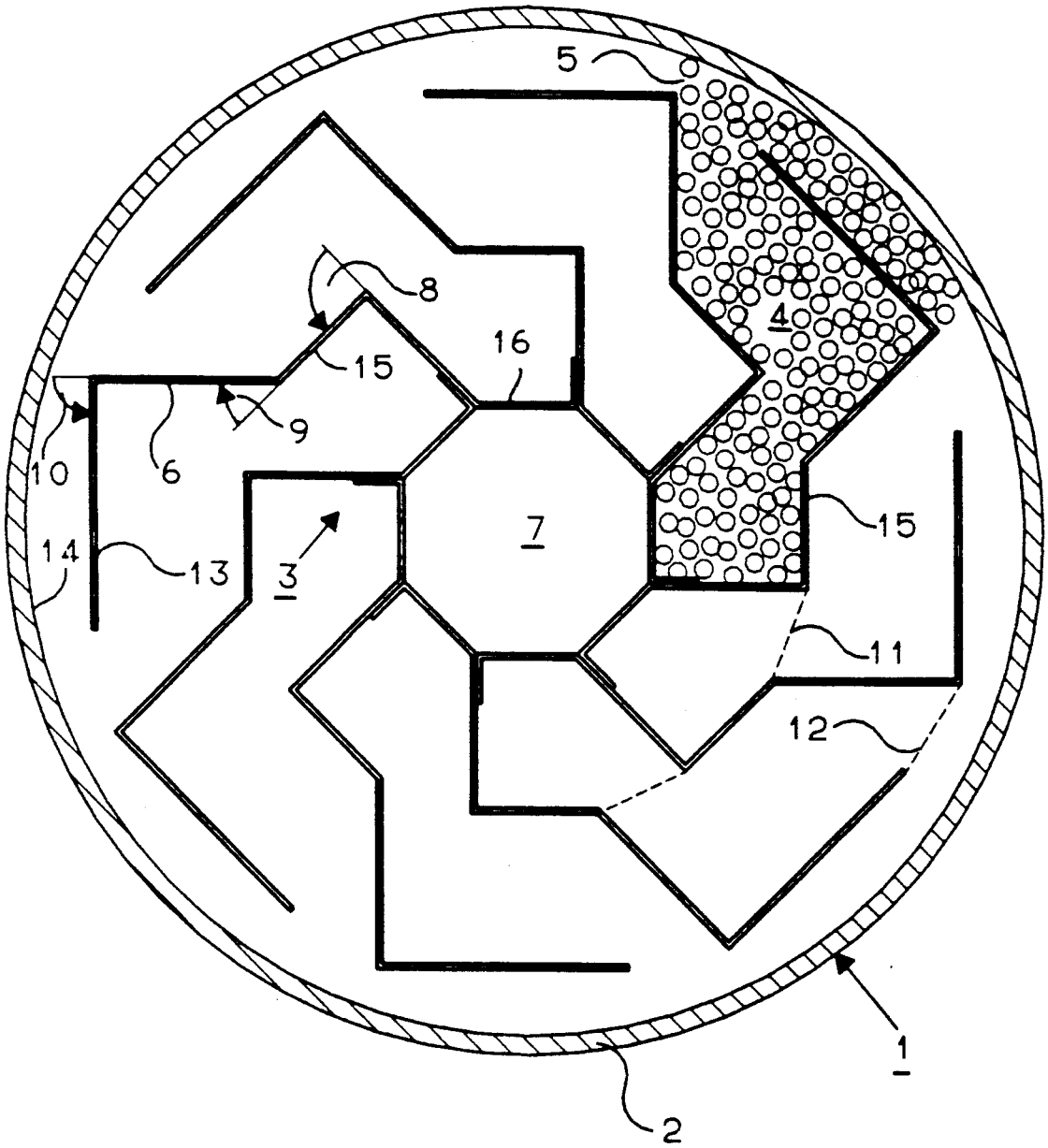
5
8
4
16
15
9
10
6
7
15
14
13
3
11
12
1
2

AIR CLEANING CARTRIDGE FOR A GAS MASK AND BREATHING EQUIPMENT WITH AN INSERT

FIELD OF THE INVENTION

The present invention pertains generally to gas mask and breathing equipment and more particularly to an air-cleaning cartridge for a gas mask and breathing equipment with a carbon dioxide-binding chemical packing and an insert that has legs which are arranged in a radiate pattern at right angles to the direction of flow, point toward the wall of the cartridge, and, originating from a center, subdivide the chemical packing into individual strands of chemical.

BACKGROUND OF THE INVENTION

An air-cleaning cartridge of the above-described class has become known from U.S. Pat. No. 4,193,966. The prior-art air-cleaning cartridge has individual inserts arranged in a radiate pattern, which are accommodated in a cylindrical cartridge housing and whose intermediate spaces are packed with a carbon dioxide-binding chemical. The inserts are made of solid, metallic material and have legs extending in a radial direction, which converge in a center and whose free ends are in contact with the wall of the cartridge housing.

It is disadvantageous in the prior-art air-cleaning cartridge that the intermediate spaces of the legs can be packed only at a limited packing density because of the rigidity of the legs, as a result of which such air-cleaning cartridges are not resistant to vibrations and shocks during operation. Resistance to vibrations and shocks means in this connection that the chemical must not be "crushed" during the use of the apparatus when, e.g., a gas mask and breathing equipment is worn by a person for several years for a possible emergency use in underground mining. In addition, only radial heat conduction within the air-cleaning cartridge is possible with an insert of the above-described class. If a substance that binds carbon dioxide and generates oxygen, e.g., potassium peroxide, is used as the chemical packing, good heat distribution or heat storage capacity by the insert in both radial direction and circumferential direction, rather than heat conduction in the radial direction alone is necessary for uniform breathing from the air-cleaning cartridge.

Swiss Patent No. CH-PS 207,614 discloses an air-cleaning cartridge in which uniform packing density is achieved by packing a wire screen strip with a chemical and subsequently winding it helically. To guide the flow within the air-cleaning cartridge, ribs, which may have a zigzag or corrugated design, are provided within the wire screen strip. This is the to lead to uniform heat distribution and breathability of the air-cleaning cartridge.

It is disadvantageous in the prior-art air-cleaning cartridge that the use of a wire screen strip is expensive, and packing the wire screen strip cannot be carried out at a favorable cost in mass production. In addition, the amount of chemical with which the air-cleaning cartridge can be packed is reduced by the volume of the wire screen strip. However, since the external dimensions of the air-cleaning cartridges have been extensively specified by standardization, inserts must be designed with the smallest possible volume. In regard to dynamic load-bearing capacity, an air-cleaning cartridge with a wire screen strip as the insert has only limited shock resistance, because the wire screen strip may undergo permanent deformation under the effect of loads, as a result of which the uniform packing density is destroyed.

SUMMARY AND OBJECTS OF THE INVENTION

The primary object of the present invention is to improve an air-cleaning cartridge with an insert such that it will have good heat distribution in the circumferential direction and sufficient resistance to vibrations and shocks, and can be produced at a favorable cost.

This object is attained in that the legs of the insert have an elasticity that compensates for the differences in the filling ratios of the strands of chemical and have a uniformly bent zigzag design.

The advantage of the present invention is essentially that differences in the filling ratios in the individual strands of chemical can be compensated due to the elastic legs, which originate from a center, and vibration- and shock-resistant packing of the air-cleaning cartridge with the chemical is consequently possible. Elastic as used herein means elastic or plastic deformability of the legs, so that differences in the filling ratios between adjacent strands of chemical can be compensated. Angulated shaping of the strands of chemical, so that heat distribution takes place in both the radial direction and the circumferential direction, is achieved due to the uniform zigzag-shaped bending of the legs. Experiments have shown that the cooperation of the individual bent legs leads to a heat distribution that is similar to that which is possible with closed rings inserted into the air-cleaning cartridge. However, air-cleaning cartridges with inserted closed rings do not permit vibration- and shock-resistant packing with the chemical, because it is impossible to compensate for differences in the filling ratios between the rings. The two-dimensional heat storage capacity achieved with the bent legs within the air-cleaning cartridge ensures homogeneous heat distribution and good breathing of the chemical packing.

In an advantageous embodiment of the present invention, the ends of the legs are bent such that they are tangential to the wall of the cartridge. It is achieved as a result that the ends of the legs form part of an external polygon, which serves to store and distribute heat within the air-cleaning cartridge in the circumferential direction in the area of the wall of the cartridge.

The diameter of the external polygon is preferably dimensioned such that it is smaller than the internal diameter of the air-cleaning cartridge. This leads to uniform heat distribution in the area of the wall of the air-cleaning cartridge; the heat will be prevented from being drawn off on the cartridge wall because of contact with the wall.

It is advantageous to bend the legs between the center and the ends of the legs such that some of their sections will extend as leg sections tangentially to the cartridge wall and form part of at least one internal polygon. The internal polygon serves to store and distribute heat in the circumferential direction within the associated part of the chemical packing. By additionally bending the legs, it is possible to produce a plurality of internal polygons which improve the heat distribution within the air-cleaning cartridge in the circumferential direction.

It is advantageous to bend the legs such that, starting from the center, the series of angles consists of a first 90° counterclockwise angle, a second 45° clockwise angle, and a third 90° counterclockwise angle. The angle sections which are bent through the first angle form the internal polygon.

The insert is preferably designed such that the center is designed as a central strand containing the chemical packing.

The insert can be prepared at a favorable cost if it consists of n identical legs, which surround, with their central leg sections, the central strand in the form of an n-gon, preferably a symmetrical octagon.

Particularly advantageous elasticity of the legs is achieved if they are made of stainless strip steel. Stainless steel has the heat storage capacity necessary for this application. The diameter of the internal polygon is dimensioned such that it corresponds to 0.5 times the internal diameter of the air-cleaning cartridge, and the diameter of the external polygon is dimensioned such that it corresponds to 0.8 times the internal diameter of the air-cleaning cartridge. The central strand has a mean diameter corresponding to 0.2 times the internal diameter of the air-cleaning cartridge.

In an advantageous embodiment, the central sections of the legs in the area of the central strand have reduced leg width. As a result, particularly good packing by overflow is possible in the area of the center, because the excess is released for the respective adjacent strand of chemical.

A further object of the invention is to provide a gas mask and breathing equipment air cleaning cartridge which is dependable in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only FIGURE is a schematic cross sectional view of the air cleaning cartridge according to the invention.

DETAILED DESCRIPTION OF THE PREFERRED EMBODIMENT

The only FIGURE shows a sectional view of an air-cleaning cartridge 1, which is comprised of a cartridge housing 2, an insert 3, and a chemical packing 4 (such as a carbon dioxide-binding chemical packing). The direction of flow is perpendicular to the plane of the drawing. Only one strand 5 of chemical is shown in the Figure of the chemical packing 4 that fills the entire cartridge housing 2. The insert 3 consists of eight bent legs 6, which are joined in the center into a central strand 7 in the form of a symmetrical octagon. The central strand 7 is formed by the central leg sections 16, which are part of the legs 6. Beginning from the central strand 7, the legs 6 are bent through a first counterclockwise 90° angle 8, a second clockwise 45° angle 9, and a third counterclockwise 90° angle 10. Leg sections 15 and leg ends 13 are formed as a result of the bending. The leg sections 15 are part of an internal polygon 11, and the leg ends 13 are part of an external polygon 12. One section of the polygons 11, 12 is illustrated by a broken line in the figure. The leg ends 13, the leg sections 15, and the central leg sections 16 extend tangentially to the cartridge wall 14.

The legs 6 are made of stainless strip steel with a thickness of 0.2 mm and are displaceable relative to one another. As a result, it is possible to compensate for differences in the filling ratios in the strands 5 of chemical. The radially extending parts of the legs 6 serve to store heat within the cartridge housing 2 in the radial direction, and the leg sections 15, the leg ends 13, and the central leg sections 16 serve to store heat in the circumferential direction. Thus, uniform, two-dimensional heat distribution within the air-cleaning cartridge 1 and good breathing of the chemical packing 4 are achieved.

The central strand 7 is also provided with the strand of chemical 4, but this is not shown in the figure for clarity's sake. Adjustment to the filling ratio is achieved here by the central leg sections 16 having reduced width in the area of the central strand 7 and the excess of chemical of the adjacent strand 5 being able to be released via the free space thus formed. As a result, high packing density of the chemical packing 4 can be reached.

While a specific embodiment of the invention has been shown and described in detail to illustrate the application of the principles of the invention, it will be understood that the invention may be embodied otherwise without departing from such principles.

What is claimed is:

1. A gas mask and breathing equipment air-cleaning cartridge, comprising a cartridge housing with a wall defining a cartridge chamber for gas flow through said chamber in a flow direction, said flow direction being substantially parallel to said wall; a carbon dioxide-binding chemical packing provided in said chamber and an insert positioned in said chamber, said insert including legs arranged in a radiate pattern, extending perpendicular to said flow direction, said legs starting from a center of said insert and pointing toward said wall of the cartridge, said legs having leg ends adjacent said wall and not connected with said wall for subdividing the chemical packing into individual strands of chemical, said legs being flexible and displaceable relative to one another for compensating for differences in filling ratios of said strands of chemical, said legs having an identical bent zig-zag shaped design.

2. An air-cleaning cartridge according to claim 1, wherein said leg ends are bent to be substantially tangential to said wall of said cartridge to form part of an external polygon.

3. An air-cleaning cartridge according to claim 2, wherein said external polygon has a diameter that is smaller than an internal diameter of said wall of said air-cleaning cartridge.

4. An air-cleaning cartridge according to claim 1, wherein said legs are bent between said center and said leg ends to extend as leg sections, tangentially to said cartridge wall and to form part of at least one internal polygon.

5. An air-cleaning cartridge according to claim 4, wherein said zig-zag design comprises, beginning from said center, a first counter-clockwise 90° angle, a second clockwise 45° angle, and a third counter-clockwise 90° angle.

6. An air-cleaning cartridge according to claim 1, wherein said center is formed as a central strand containing said chemical packing.

7. An air-cleaning cartridge according to claim 1, wherein said insert consists of a plurality legs, said plurality of legs surround, with a central section said central strand in the form of a polygon having a number of sides corresponding to a number of said plurality of legs.

8. An air-cleaning cartridge according to claim 7, wherein said n-gon is symmetrical octagon.

9. An air-cleaning cartridge according to claim 1, wherein said legs are formed of stainless steel, said legs cooperating at a central section to form a central strand, said central strand being 0.2 times an internal diameter of said wall of said air-cleaning cartridge, said legs being bent to form part of an internal polygon, said internal polygon being 0.5 times said internal diameter, said legs cooperating to form part of an external polygon, said external polygon being 0.8 times said internal diameter.

10. An air-cleaning cartridge according to claim 1, wherein said legs have a central leg section, said central leg section of said legs cooperating to form a central strand, each central leg section having a reduced width in said area of said central strand.

11. A gas mask breathing and equipment air-cleaning cartridge according to claim 1, wherein said legs are formed of a thermally conductive material.

12. A gas mask and breathing equipment air-cleaning cartridge, comprising a cartridge wall defining a cartridge chamber for gas flow through said chamber in a flow direction, said flow direction being substantially parallel to said wall; a carbon dioxide-binding chemical packing provided in said chamber and an insert positioned in said chamber, said insert including legs arranged in a radiate pattern, extending perpendicular to said flow direction, said legs starting from a center of said chamber and pointing toward the wall of the cartridge for subdividing the chemical packing into individual strands of chemical, said legs being flexible and displaceable relative to one another for compensating for differences in filling ratios of said strands of chemical, said legs having an identical bent zig-zag shaped design, said leg ends are bent to be substantially tangential to said wall of said cartridge to form part of an external polygon, said external polygon having a diameter that is smaller than an internal diameter of said wall of said cleaning cartridge.

13. A gas mask breathing and equipment air-cleaning cartridge according to claim 12, wherein said legs are formed of a thermally conductive material.

14. A gas mask and breathing equipment air-cleaning cartridge, comprising a cartridge wall defining a cartridge chamber for gas flow through said chamber in a flow direction, said flow direction being substantially parallel to said wall; a carbon dioxide-binding chemical packing provided in said chamber and an insert positioned in said chamber, said insert including legs arranged in a radiate pattern, extending perpendicular to said flow direction, said legs starting from a center of said chamber and pointing toward the wall of the cartridge for subdividing the chemical packing into individual strands of chemical, said legs being flexible for compensating for differences in filling ratios of said strands of chemical, said legs having an identical bent zig-zag shaped design, said zig-zag design comprises, beginning from said center, a first counter-clockwise 90° angle, a second clockwise 45° angle, and a third counter-clockwise 90° angle.

* * * * *